United States Patent [19]

Hoffman

[11] 4,093,269

[45] June 6, 1978

[54] SKI BINDING

[75] Inventor: Börje Hoffman, Langshyttan, Sweden

[73] Assignee: Hoffmans Verkstads AB, Langshyttan, Sweden

[21] Appl. No.: 718,171

[22] Filed: Aug. 27, 1976

[30] Foreign Application Priority Data

Sep. 19, 1975 Sweden ..... 7510502

[51] Int. Cl.[2] ..... A63C 9/18

[52] U.S. Cl. ..... 280/615

[58] Field of Search ..... 280/615, 614, 635

[56] References Cited

U.S. PATENT DOCUMENTS

| | | | |
|---|---|---|---|
| 3,823,953 | 7/1974 | With | 280/615 |
| 3,850,439 | 11/1974 | Guttulsrud | 280/615 |
| 3,905,612 | 9/1975 | Kjellstrom | 280/615 |

*Primary Examiner*—Joseph F. Peters, Jr.
*Assistant Examiner*—Milton L. Smith
*Attorney, Agent, or Firm*—Silverman, Cass & Singer, Ltd.

[57] ABSTRACT

An improved ski binding which includes an engagement member with forwardly extending teeth affixed to the forward portion of a boot clamp. The clamp is depressed to latch a boot in the clamp by engaging the teeth with a pawl pivotally mounted on a forward portion of the binding base plate. The pawl includes a trigger release member extending forwardly above the pivot point which is depressed to pivot the pawl forward and release the clamp teeth from the pawl to release the boot from the clamp. The pawl is biased toward the rearward latched position.

3 Claims, 3 Drawing Figures

SKI BINDING

The present invention relates to a ski binding of that type which is used together with a ski shoe having a number of holes at the front portion of the underside of the shoe sole. Said holes cooperate with pins or the like of the same number, said pins extending upwards from the base plate of the binding. A clamping device is provided to clamp the shoe sole on to the base plate.

Ski bindings of the kind described above are previously known, in which the clamp and the clamping arrangement are constructed in various ways; however, these constructions are complicated as a rule, and often they are not as reliable as should be expected from ski bindings. In races it is especially of very great importance that the bindings are reliable and do not allow the ski to come off the ski shoes unintentionally. Most of the prior constructions require the skier must to bend down to use his hands to fasten the shoe to the binding or unfasten it therefrom. Furthermore, most of the known bindings can not be used for various thickness of shoe soles.

By the binding according to the present invention the disadvantages described above are overcome. The binding according to the invention comprises a base plate having upwards directed side portions and fastening means, preferably including upwards directed pins for engagement with holes or recesses in the sole of the ski shoe to be fastened to the binding. A clamp is rotatably journalled in bearings in said side portions, said clamp carrying an engagement member at its foremost part for removable engagement with an engagement member provided on said base plate. The binding is characterized by the fact, that said engagement member carried by the clamp is secured to said clamp and provided with engagement teeth extending forwardly, and that the engagement member on the base plate comprises a pawl. The pawl is swingable within certain limits and positioned on the front part of the baseplate, said pawl being arranged to engage one of said engagement teeth under the influence of a spring when said clamp is pressed down against the shoe sole. The pawl also has a forwardly extending trigger arm, which, when manually pressed down, will swing the pawl and release it from said engagement member of the clamp, whereby the clamp will swing up springingly from the shoe sole.

An embodiment of the device according to the invention will be described below with reference to the attached drawing.

Figure 1:
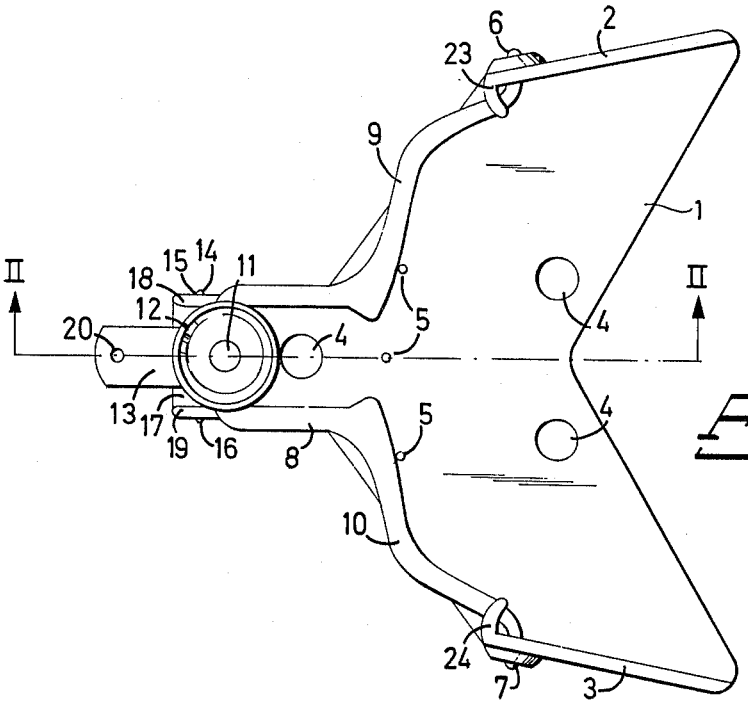
Figure 2:
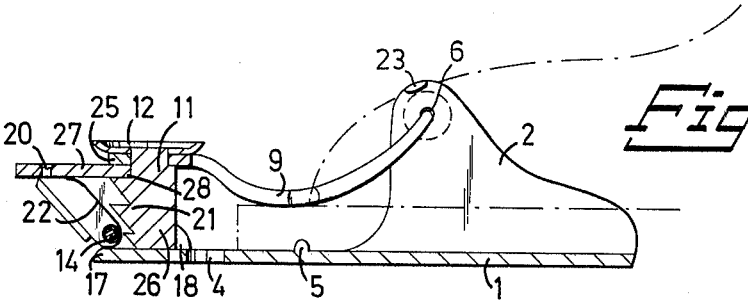
Figure 3:
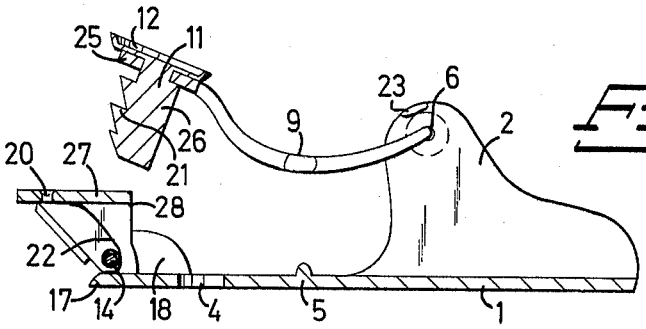

FIG. 1 shows an embodiment of the binding according to the invention in a latched position as seen from above, FIG. 2 shows a cross section through the binding according to FIG. 1 at the line II—II, and FIG. 3 shows the same cross section through the binding as FIG. 2, the binding however being in a released or unengaged position.

FIG. 1 shows a base plate 1 intended to be fastened to a ski (not shown) by screws through holes 4. Said base plate 1 has turned up side portions 2,3 between which a ski shoe is intended to be inserted, said ski shoe being indicated by dash-dot lines in FIG. 2. Said side portions 2,3 have holes or recesses 6,7 close to their upper, foremost edges. A clamp 8 is journalled on the base plate by the outwards bent ends of the two arms 9, 10 of the clamp being rotatably inserted in the holes 6,7. Preferably said holes can be lined with a material that is more suitable as bearing material than the material of the bottom plate, for one thing in order to prevent too much wearing of the holes when the clamp is turned up and down. The front part 25 of the clamp is secured to an engagement member 11, which is provided with teeth, as shown in the drawings. The engagement member 11 comprises a portion 26, see FIG. 2, said portion being located under the front part 25 of the clamp and provided with forwardly directed ratchet teeth 21, the upper edges of which being horizontal or somewhat backwards inclined. In the example described there are three teeth 21. The engagement member 11 also comprises an actuating means consisting of a somewhat bowl-shaped plate 12 secured to the portion 26, said plate 12 being located above the clamp 8. The side portions 2,3 are also provided with laps 23 and 24 respectively extending over the base plate and over the arms 9, 10 of the clamp 8.

The base plate 1 is also provided with a number of, in the shown example three, upwards extending pins or the like 5, which can be riveted to the base plate.

Furthermore, the base plate is also provided with a front portion 17 extending forwards in the longitudinal direction of the ski, said front portion 17 having turned up side portions 18, 19. Said side portions 18, 19 are provided with holes or recesses 15, 16 through which a shaft 14 extends. A pawl 13 is rotatably journalled on the shaft 14 by holes in the turned down sides of the pawl in the way shown in FIG. 2. Said pawl 13 comprises an upper part 27, the two vertical sides mentioned above, which are parallel to the longitudinal direction of the ski, and a front side extending perpendicular to the longitudinal direction of the ski, said front side being provided for among other things, to prevent too much snow from entering the mechanism of the binding when in use. The back portion of the upper part 27 forms an edge 28, which has a shape corresponding to the ratchet teeth 21 and is provided to engage into said teeth. One or more springs 22 are arranged around the shaft 14 in such a way, that their lower ends are pressed against the base plate 1. Said springs run around the shaft 14 and their other ends are pressed against the upper part 27 of the pawl, see FIG. 2, whereby the pawl 13 is retained in a locking position by the spring. Said upper part 27 is provided with a recess or hole 20 at its front end.

When a ski shoe is to be fastened to the binding according to the invention the clamp is in its turned up position, which is shown in FIG. 3. The ski shoe is inserted between the turned up side portions 2, 3 and pressed down on the base plate 1, so that the pins 5 enter the holes in the shoe sole. Thereafter the clamp 8 is pressed down by a force being exerted downwards on the plate 12, for example by the point of a ski stick. The clamp is pressed down as far as possible on the edge of the shoe sole, to its lowest position (FIG. 2). In this manner the pawl 13 will be displaced forwards against the action of the springs 22 for each tooth 21 that it passes, until the clamp stops and the pawl edge 28 is engaged in one of the teeth 21. The engagement member 11 will be locked in this position by the pawl 13, whereby the clamp 8 will be effectively pressed down in a reliable way. This is the active or latched position of the binding as shown in FIG. 2.

When the ski shoe is to be unfastened from the binding, the foremost part of the pawl 13 is pressed down by for example the point of a ski stick in the recess 20. The pawl 13 is displaced forwards, whereby the edge 28 will leave its engagement in the tooth 21. As a result the clamp 8 will be free and swing upwards due to the pressure of the shoe sole. Now the ski shoe is free and can be unfastened from the binding by being lifted up from the pins 5. If the ends of the clamp are so dimensioned in relation to the holes 6,7, that they rotate with a certain inertia, the clamp will stop and stay in its turned up position. The removal of the ski shoe from the binding is hereby facilitated, and the ski shoe can be fastened again without the clamp having to be turned up manually. The laps 23, 24 on the side portions 2 and 3, respectively, prevent the clamp 8 from being turned up so far, that it can not be turned down again by the point of a ski stick without at first being turned down a little by hand.

By the binding according to the invention the following advantages are obtained. The binding is of a simple construction and easy to manufacture and use. The ski shoe is reliably fastened to the binding and there is no risk that it will be released therefrom unintentionally. The fastening as well as at the unfastening of the ski shoe does not require the skier does not require to bend down and manipulate the binding with his hands. Instead the binding is actuated by the point of the ski stick. This is very advantageous for example after a hard and tiring ski race or in very cold weather.

The binding according to the invention can be used for shoe soles of various thickness due to the fact that the pawl 13 can be engaged in different teeth 21. Thanks to the simple construction the binding is also easily operated, which is very advantageous, especially in races.

The binding is not restricted to the embodiment described above and illustrated in the drawings. It can be modified in many ways within the scope of the attached claims. The separate details need not be of the shape described above, but can be shaped in various ways. For example the engagement member 11 can have a greater or smaller number of teeth 21. Also, the number of pins 5 and holes in the shoe sole can be varied. The shape of the actuating means 12 and 20 can be modified. The laps 23, 24 can be replaced by bent out members on the clamps cooperating with edges or the like on the side portions 2, 3.

What I claim is:

1. An improved ski binding, including a base plate adapted to be fastened to a ski surface having upwardly directed side portions and a forward portion extending beyond said side portions, a boot clamp having a forward portion and two rearward arms having ends rotatably journaled in bearings in said side portions, said improvement comprising:

said boot clamp including first engagement means nonrotatably secured to said forward portion, including a plurality of forwardly extending teeth for removable engagement with second engagement means mounted on said base plate forward portion when said first engagement means is depressed against said second engagement means; and said second engagement means including pawl means pivotally mounted on said base plate forward portion, pivotal between a first latch position and a second forward unlatched position, and having means biasing said pawl means into said latched position, said pawl means including a forwardly extending release trigger mounted above said pivotal mounting for pivoting said pawl means forward into said second unlatched position, said pawl means including a rearwardly extending latch means for engaging at least one of said first engagement means teeth in said first latched position.

2. An improved ski binding as claimed in claim 1, wherein:

said teeth are closely spaced one from another;

said latch means include a thin plate-like portion for engagement with at least one of said teeth.

3. An improved ski binding as claimed in claim 1 further including:

said release trigger including one of a hole or a recess adapted to be engaged by the point of a ski stick for depressing the release trigger by said ski stick when said boot clamp is to be released; and said first engagement means including bowl shaped actuating means secured above said teeth adapted to be engaged by the point of a ski stick for pressing down said boot clamp by said ski stick when said boot clamp is to be latched.

* * * * *